United States Patent [19]

Casciani

[11] Patent Number: 4,754,948

[45] Date of Patent: Jul. 5, 1988

[54] RANGE STABILITY DEVICE

[75] Inventor: Richard E. Casciani, Ashland, Ohio

[73] Assignee: The Tappan Company, Ohio

[21] Appl. No.: 929,519

[22] Filed: Nov. 12, 1986

[51] Int. Cl.[4] ..... A47B 97/00

[52] U.S. Cl. ..... 248/680; 248/500; 312/245

[58] Field of Search ..... 248/680, 681, 359, 360, 248/500, 506, 551, 674, 675, 213.2, 220.2, 224.4, 225.1, 231.9, 231.91, 300; 312/245–248; 403/407.1, 408.1; 411/388

[56] References Cited

U.S. PATENT DOCUMENTS

| | | | |
|---|---|---|---|
| 346,148 | 7/1886 | Durham | 411/388 |
| 989,085 | 4/1911 | Turton | 248/680 |
| 1,508,326 | 9/1924 | Hensley | 248/681 |
| 1,800,075 | 4/1931 | Imrie | 248/300 |
| 2,676,778 | 4/1954 | Pace | 248/300 |
| 3,024,937 | 3/1962 | Kooi | 248/300 |
| 3,140,071 | 7/1964 | Lorentzen | 248/300 |
| 3,182,807 | 5/1965 | Root | 248/300 |
| 3,899,228 | 8/1975 | Schreiber | 312/245 |
| 4,275,939 | 6/1981 | Odermann | 248/680 |

FOREIGN PATENT DOCUMENTS

| | | | |
|---|---|---|---|
| 1233550 | 2/1967 | Fed. Rep. of Germany | 312/245 |
| 1554533 | 1/1970 | Fed. Rep. of Germany | 312/245 |
| 1152461 | 2/1958 | France | 312/245 |
| 1233576 | 5/1960 | France | 411/388 |

*Primary Examiner*—J. Franklin Foss
*Assistant Examiner*—Robert A. Olson
*Attorney, Agent, or Firm*—Alfred E. Miller

[57] ABSTRACT

Electric and gas ranges are provided with either projections or openings which, together with corresponding openings and projections on the adjacent wall behind the ranges, cooperate in order to prevent the tipping of the range when the oven door is open and assuming a generally horizontal position, whereby weight is applied to the door of sufficient magnitude to cause the range to tip over unless the corresponding projections and openings are interfitted.

3 Claims, 2 Drawing Sheets

RANGE STABILITY DEVICE

The present invention relates to an electric or gas range stability device which prevents the tipping over of the range when the oven door is open and is positioned generally horizontally. It is noted that people in kitchens sometimes use the oven door in its open condition as a step stool to reach an area above the stove, which otherwise is inaccessible without the use of a chair or a step stool to stand on. When this is done, and especially if the person steps on the outer edge of the door, the moment of force on the door in a downward direction causes the range to tip forward, possibly causing injury to the person who stepped on the door. On some occasions, accidents occur when two children step on the door together so that the combined weight is sufficient to tip the range appliance over. Furthermore, there have been incidents in which older people would use the doors as props to raise themselves up after falling near the range. Obviously, the application of considerable amount of force to the open door will cause tipping of the range.

It is known that the appliance makers have on occasion discussed the possibility of manufacturing a gas or electric range in which stability will be maintained at all times and under many conditions.

It is an object of the present invention to provide an arrangement on the back of the appliance, as well as on the adjacent rear wall, which will prevent the appliance from tipping over if someone uses the open oven door as a step stool to reach an area above the range.

It is a further object of the present invention to provide an arrangement on a gas or electric range appliance whereby said appliance may be removed for servicing and cleaning and reinstalled in its former location without the use of tools.

It is still another object of the present invention to provide an arrangement on a range for providing stability of said range, even though excess weight is applied to an open oven door, said arrangement not interfering with any solid or flexible connection during the installation of the range in its selected location.

In order that the present invention will be more clearly understood, it will now be disclosed in greater detail with reference to the accompanying drawings, in which.

Figure 2:
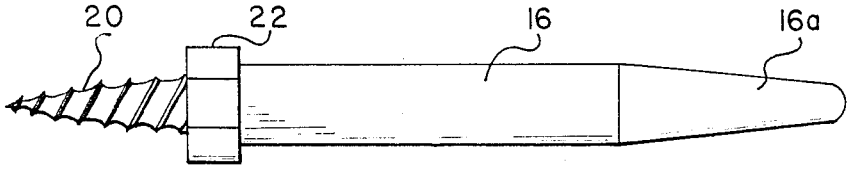
FIG. 2 is a side elevational view of one of said studs in which the end which is adapted for insertion in the rear of the cooking range, is screwthreaded.
Figure 1:
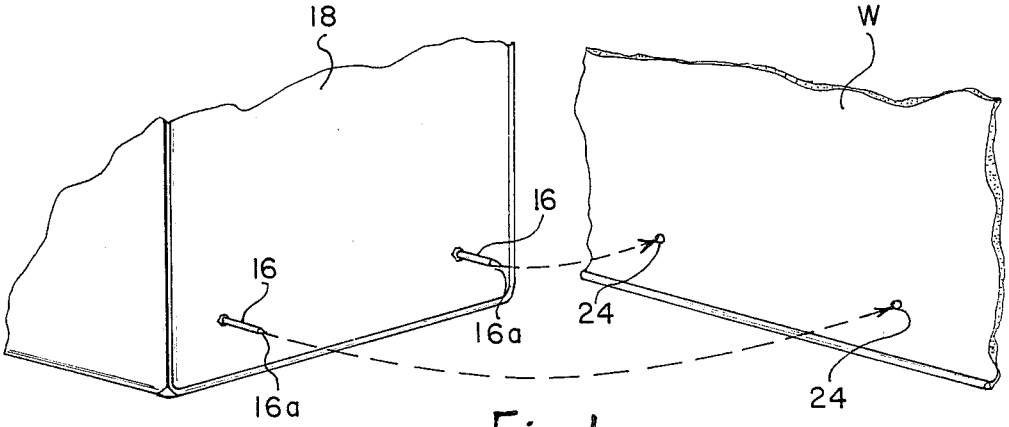
FIG. 1 is a perspective view of a domestic gas or electric free-standing cooking range having space projecting studs for insertion in aligned openings in the rear wall adjacent to said cooking range.
Figure 3:
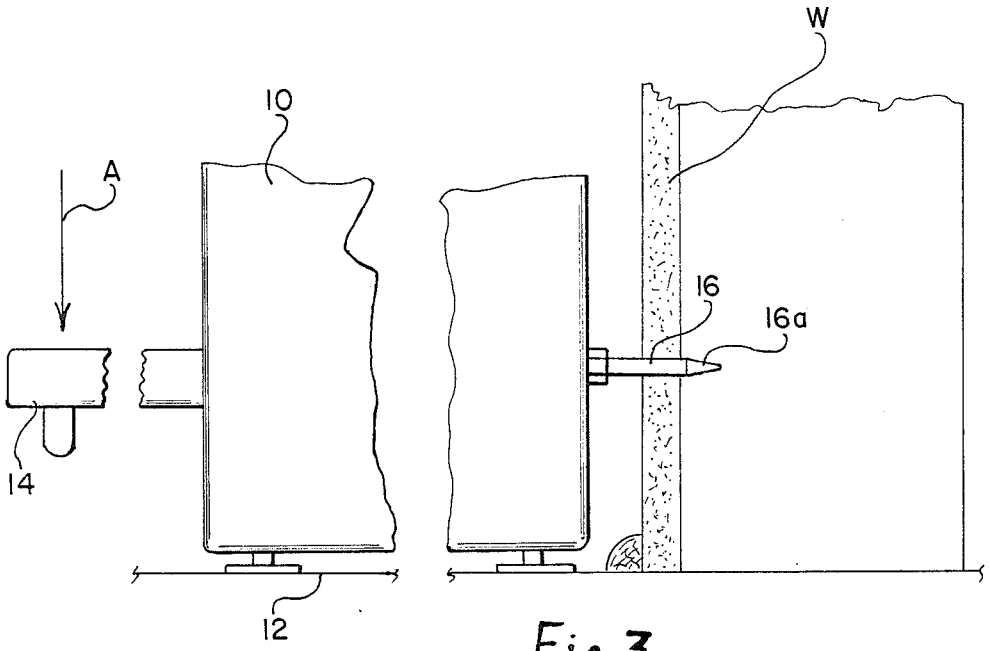
FIG. 3 is a sectional and partially elevational view showing the stud and the corresponding or companion opening or hole in the rear wall surface through which said stud passes.

As seen in FIGS. 1–3 on electric or gas cooking range 10 is placed on the floor 12 the weight adjacent to a wall W. In order to prevent the range from tipping in a counter-clock wise direction, the force is applied to the over door 14 by means of a force supplied in the direction of the arrow A, a moment of force is applied to the edge of the oven door 14 causing rotation of the oven 10 in said counter-clock wise direction. In order to counteract the tipping or movement of the oven 10 a pair of studs 16, as seen in FIG. 1, are mounted on the rear panel 18 of the oven 10. As seen in FIG. 2, the stud 16 is provided with a screwthreaded end 20 and an abutment collar 22. The other end of the stud 16 terminates in a pointed end **16*a*. As seen in FIG. 3, the stud 16 is inserted through an opening 24 in the wall W. Thus, the space stud 16 passed through the aligned openings 24 and the oven range 10 is pushed rearwardly until the rear panel 18 is pushed into position adjacent to the vertical wall W. When this occurs, even when one steps on the open oven door 14, or applies a force thereto, the range appliance will not tip over but will be maintained in an upright position in view of the studs being inserted in the openings 24** of the wall W and, consequently, stability of the range is maintained.

Figure 4:
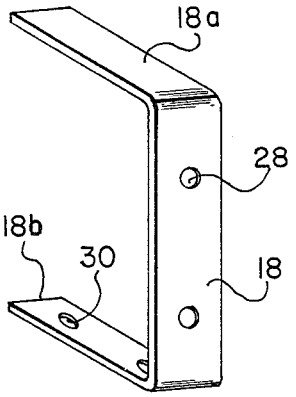
FIG. 4 is a prospective view of an alternate embodiment of the present invention showing a U-shaped bracket having floor mounting and wall mounting holes.
Figure 5:
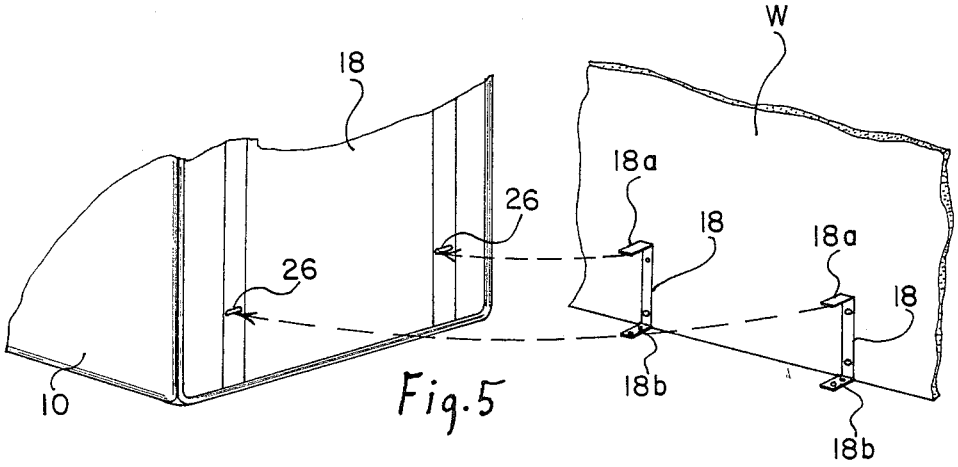
FIG. 5 is a perspective view of a domestic gas or electric free-standing range having spaced slots for receiving the upper legs of the brackets and FIG. 6 shows a portion of said bracket which slides into corresponding slots in the rear panel or body of said cooking range.
Figure 6:
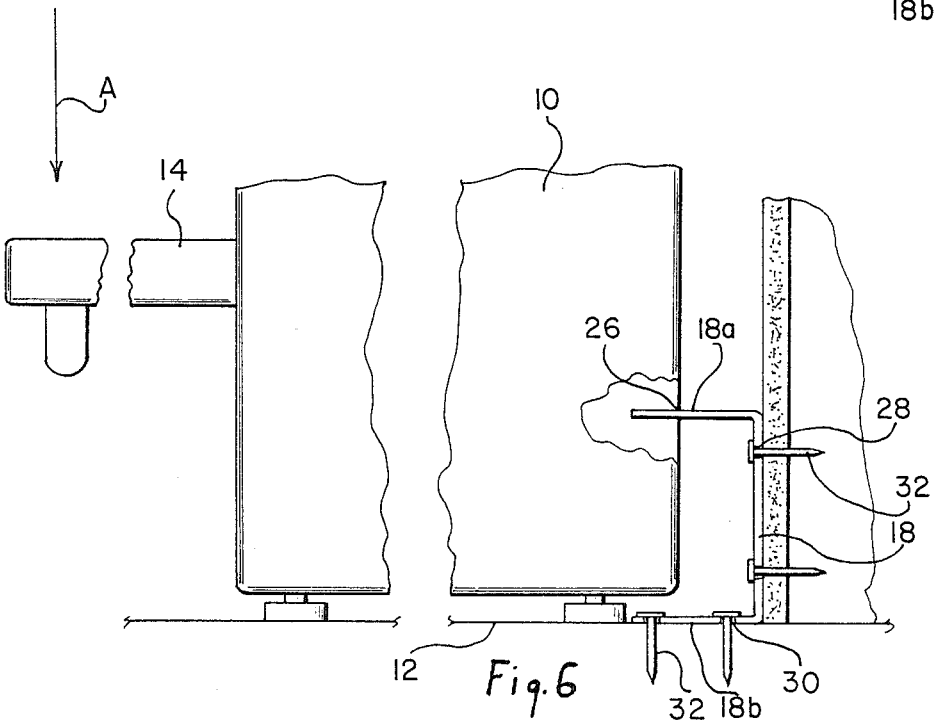

An alternate embodiment of the present invention is shown in FIGS. 4–6 in which like parts bear like reference numerals. In this connection, the range 10 is provided with a pair of slots 26 located on the rear panel 18 of the range. On the wall W a pair of companion U shaped brackets 28 are shown which are provided with mounting holes 28 for mounting the same to the wall W and mounting holes 30 for mounting the bracket to the floor 12. Screws 32 pass through mounting holes 28 and 30 in order to securely affix the bracket to both the wall and the adjacent floor area. As seen in FIG. 6, the upper legs **18*a* of the brackets 18, pass through the aligned slots in order to stabilize the appliance when an increased load or force is applied to the open oven door. As in the arrangement shown in FIG. 3, the range 10 is pushed rearwardly when being placed in position in order for the rear panel 18 to be closely adjacent to the wall W and the legs 18*a* are inserted within the corresponding slots 26**.

It should be apparent that the range, or other type of major appliance, may be easily removed from its location adjacent to the wall and reinstalled for cleaning and servicing without the use of tools. Furthermore, the present invention may be utilized in connecton with any type of major appliance beside the cooking range, such as dishwashers, clothes washers, dryers etc.

It should be evident that the present invention in which studs or brackets are used does not interfere with any type of hook-up connections to the appliance, which may be either solid or flexible, and does not detract from the appearance of the appliance since the device is attached to the rear panel of the appliance. In connection with the arrangement in which the threaded studs are utilized, the pointed end **16*a*** of the studs automatically provides a mark on the wall for the installer to drill holes therein thus self-locating the holes to be aligned with the respective studs.

While the invention has been disclosed and described herein with reference to two embodiments, it is apparent that variations and modifications may be made which will fall within the true spirit and scope of the invention and defined in the following claims.

What is claimed is:

1. In combination a large appliance stability device and an appliance with a rear panel the improvement comprising spaced openings in said rear panel, said means being a pair of spaced U-shaped brackets for securing to a wall with each having one leg thereof projecting through an adjacent opening in said rear housing panel so that said appliance is prevented from tipping over when an unbalancing load is applied to said appliance.

2. A device as claimed in claim 1 wherein each of said U-shaped brackets are provided in the bight portion with securing means for said wall, and one of the legs thereof is adapted to be affixed to the floor while the other leg thereof passes through said openings in the rear housing panel.

3. A device as claimed in claim 1 wherein said appliance is a cooking oven which, when the overn door is open and has assumed a generally horizontal relationship with the floor, an unbalancing load on said door causes said oven to tend to rotate in couter-clockwise direction while said legs of the brackets in complimentary openings in the rear housing panel prevent said rotation.

* * * * *